US007201392B2

(12) United States Patent
King

(10) Patent No.: US 7,201,392 B2
(45) Date of Patent: Apr. 10, 2007

(54) SNOW SKI BINDING

(76) Inventor: Christopher M. King, 48 Glen St., Dover, MA (US) 02030

( * ) Notice: Subject to any disclaimer, the term of this patent is extended or adjusted under 35 U.S.C. 154(b) by 342 days.

(21) Appl. No.: 10/896,539

(22) Filed: Jul. 22, 2004

(65) Prior Publication Data

US 2006/0017262 A1 Jan. 26, 2006

(51) Int. Cl.
*A63C 9/08* (2006.01)

(52) U.S. Cl. ..... 280/618; 280/617; 280/611; 280/11.3; 280/841; 280/7.13; 280/7.12; 280/7.1; 280/623; 280/626; 280/620

(58) Field of Classification Search ..... 280/618, 280/617, 611, 11.3, 841, 7.13, 7.12, 7.1
See application file for complete search history.

(56) References Cited

U.S. PATENT DOCUMENTS

| | | | | |
|---|---|---|---|---|
| 4,027,896 | A | 6/1977 | Frechin et al. | 280/618 |
| 4,498,687 | A | 2/1985 | Salomon et al. | 280/615 |
| 4,674,766 | A | 6/1987 | Ramer | 280/614 |
| 4,854,605 | A | 8/1989 | Emerson | 280/615 |
| 5,066,036 | A | 11/1991 | Broughton | 280/615 |
| 5,085,453 | A * | 2/1992 | Bildner | 280/612 |
| 5,135,250 | A * | 8/1992 | Abondance et al. | 280/617 |
| 5,318,320 | A | 6/1994 | Ramer | 280/614 |
| 5,540,458 | A * | 7/1996 | Arduin et al. | 280/602 |
| 5,560,633 | A | 10/1996 | McGowan | 280/614 |
| 5,687,982 | A * | 11/1997 | Challande et al. | 280/607 |
| 6,409,204 | B1 * | 6/2002 | Ayliffe | 280/613 |
| 6,431,578 | B2 * | 8/2002 | Pedersen et al. | 280/626 |
| 2003/0047912 | A1 * | 3/2003 | Hauglin | 280/615 |

* cited by examiner

*Primary Examiner*—J. Allen Shriver
*Assistant Examiner*—Cynthia F. Collado
(74) *Attorney, Agent, or Firm*—Burns & Levinson LLP; Jerry Cohen

(57) ABSTRACT

A downhill ski binding (2) that operates to allow the skier to select a number of skates or a time interval, after which a lock means (30) locks the rearward end (28) of a ski boot plate (4) to a ski plate/lift (14) and/or a ski (22) until reset. Until the pre-selected number of skates or time interval is reached, the rearward end of the ski boot plate is freely moveable with respect to the ski plate/lift and/or ski, thereby allowing the skier to freely skate. A variety of configurations and mechanical, electromechanical and electromagnetic dynamic locking means are described, several with remote input means (104) and a logic unit (102).

56 Claims, 12 Drawing Sheets

SNOW SKI BINDING

FIELD OF THE INVENTION

The present invention relates generally to a new ski binding, and more particularly to a ski binding for increasing a racer's acceleration during an initial "skating" period of an alpine race.

BACKGROUND OF THE INVENTION

Ski bindings have evolved from fairly simplistic forms to more sophisticated designs intended to provide skiers with improved flexibility and safety. Bindings for Alpine skiing have almost uniformly been affixed to the skis. This is because downhill skiing requires shifting one's weight, using ski edges, and maintaining proper balance. Mastering these techniques would be difficult without having the bindings fixed to the skis.

During the first 3–5 seconds of a race, the racer "skates" in order to achieve the highest rate of speed in the shortest amount of time possible. Critical to this effort is a stable glide by each ski over the snow, requiring movement of a skier's center of gravity over each foot to keep the ski gliding flat in the snow and setting for a strong push to the other leg. The longer a ski edge is in contact with the snow, the faster a racer can skate and accelerate. Bindings that are fixed to the skis will limit the amount of surface contact that will occur between the snow and the ski edge. Thus a need exists for a new binding that will allow a racer to skate faster by allowing the ski to remain in contact with the snow for a greater amount of time during the skating interval, but which also exhibits the benefits of fixed connections between the bindings and the skis during the downhill portion of a race.

Downhill ski racers also often add lifts or plates between their ski boots and the skis to make carving turns easier. A binding that provides greater contact between the ski and the snow, and which additionally assists a racer with carving turns will provide a racer with advantages that will lead to huge success in a sport where the difference between 1st and 20th place finishes is often under a second.

Some bindings have been developed that allow a skier to convert between cross-country style use or an Alpine style. Others allow a complete conversion between styles, but all of these require the conversion to be performed at a standstill and require the skier to adjust some feature such as a latch of the binding to effect the change. Thus, a need exists for a binding that can automatically switch or lock its configuration after some predetermined point of time.

SUMMARY OF THE INVENTION

The major elements of the ski binding of the present invention include a ski boot plate that is adjustably securable to a ski boot, a pivotal toe section fixed either directly or indirectly to the ski that allows the skier to raise up his heel during the "skating" period and keep the edge of the ski on the snow for a longer period of time, and a dynamic locking means for immovably securing the ski boot plate to the ski plate positioned between the ski and the boot plate or, alternatively, directly to the ski. It is an object of the present invention to allow a ski racer to skate faster, and to assist the racer in carving turns.

A ski binding in accordance with the present invention is designed to improve a ski racer's initial acceleration during the "skating" period (roughly the first 3–5 seconds) of any ski race. It allows the skier's ski to be in contact with the snow for a longer period of time than conventional downhill skis allow, resulting in better glide and acceleration. The ski binding dynamically converts from a disengaged position to a fixed engaged position after a predetermined interval. In the disengaged position, only the toe end of a boot plate under the ski boot is connected to the ski and/or a ski plate mounted on the upper surface of the ski. In the engaged position, the rearward end of the boot plate is additionally in contact or close proximity to the ski plate and/or ski. The ski binding automatically locks the rearward end of the boot plate in the engaged position after the desired interval.

The locking interval may be defined in terms of the number of skates that the racer desires to take before the ski binding locks the boot heel (i.e., the rearward end of the boot plate) in the engaged position, The number of skates may be determined by counting the number of times that the rearward end of the boot plate and the ski plate and/or the ski come into contact (or close proximity) through the skier's skating motions. Alternatively, the locking interval may be defined in terms of a pre-selected time period measured from the start of the race.

The pivotal toe section may optionally include a feature (e.g., a stop plate) for limiting the range of pivotal rotation of the ski boot plate. In yet other embodiments, the motion of the rearward end of the boot plate relative to the ski is not limited to vertical pivoting about an axis transverse to the ski at the toe section. The binding may additionally allow the rearward end of the boot plate to swing laterally away from the ski, providing an even greater range of motion.

In some preferred embodiments of the invention, the dynamic locking means is positioned at or near the rearward end of the boot plate, near the heel region of the ski boot. In other preferred embodiments, however, the locking mechanism may be located at any position along the length of the boot plate.

A number of dynamic lock designs are described below. In some preferred embodiments, the locking means comprises a rotational gear mechanism, a means for advancing the gear incrementally each time the boot plate approaches sufficiently near the ski plate and/or ski, and a hooking means that securely fixes the boot plate in the engaged position with respect to the ski plate and/or ski after a pre-selected number of approaches (i.e., gear rotational increments). As an example, an average ski racer takes 3–5 skates per leg before tucking into their racing form. In such embodiments, the racer may, before the race starts, adjust the gear to rotate a desired number of increments to select from 3–5 skates before the lock engages and fixes the binding in the Alpine (boot heel proximate the ski) configuration.

Several other preferred embodiments of the dynamic locking means are described below and are consistent with the spirit of the invention. One such alternative makes use of one or more supply and take-up reels of a thin, high-strength wire that locks the boot plate in the engaged position after the desired number of skates. Another utilizes a timer, proximity or contact sensor and an electromagnet to automatically lock (through a magnetic attraction or actuation of a mechanical lock element) the boot plate in the engaged position after the desired interval.

BRIEF DESCRIPTION OF THE DRAWING

For a better understanding of the present invention, reference is made to the accompanying figures wherein.

DETAILED DESCRIPTION OF PREFERRED EMBODIMENTS OF THE INVENTION

Figure 1A:
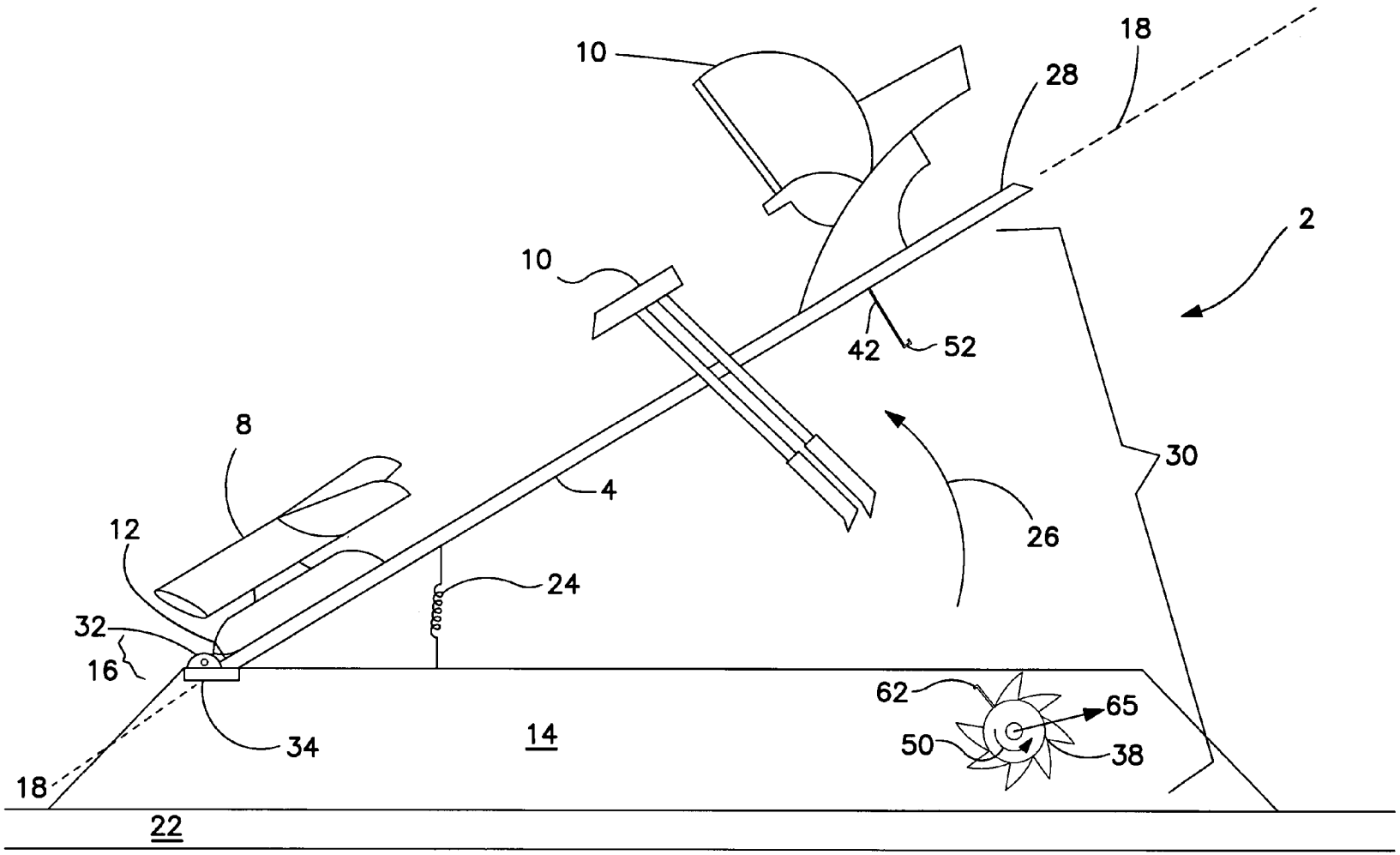
FIGS. 1A, 1B, 1C are side and end views of one embodiment of the binding of the present invention shown mounted on a ski.
Figure 1B:
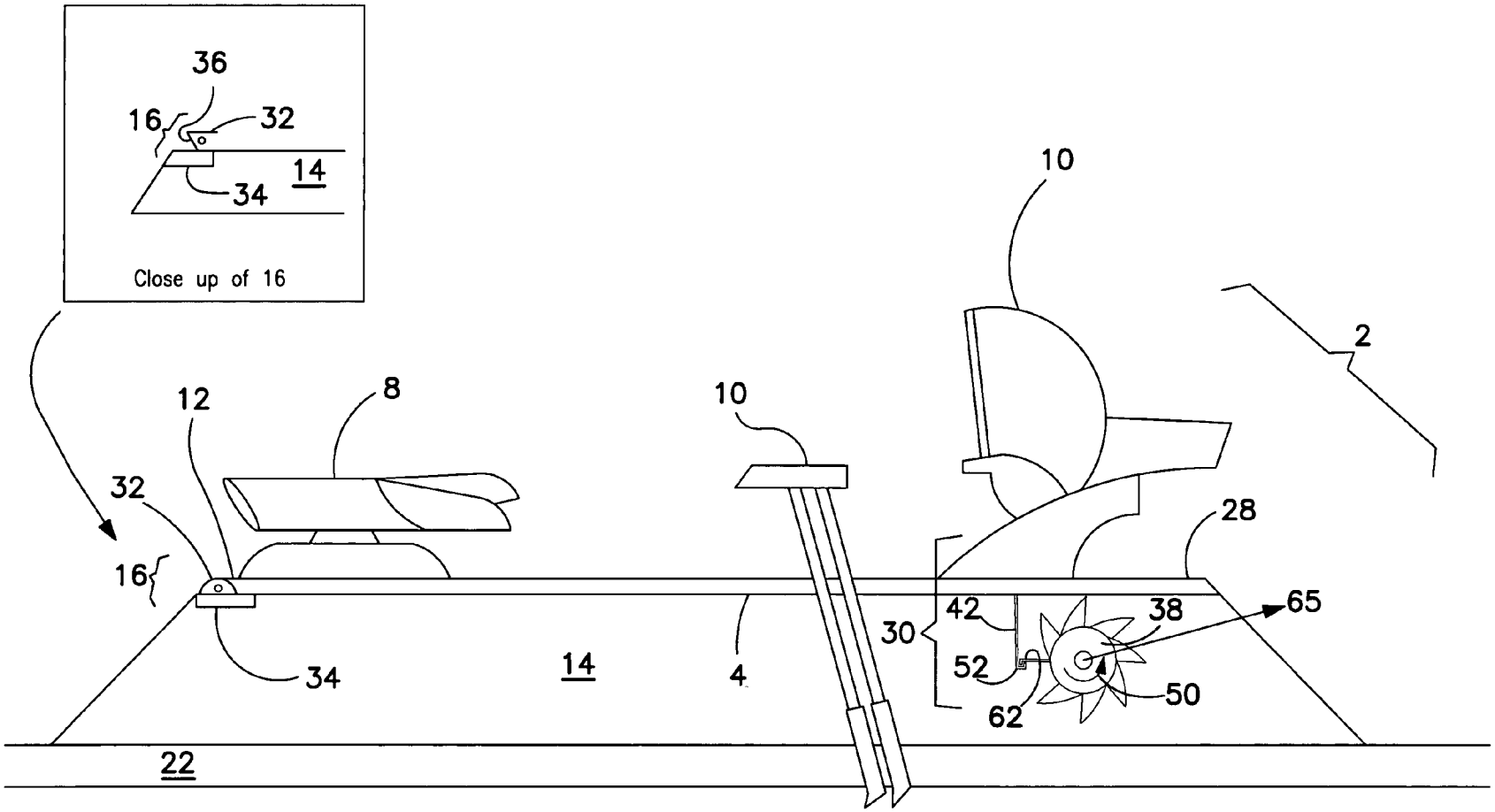
Figure 1C:
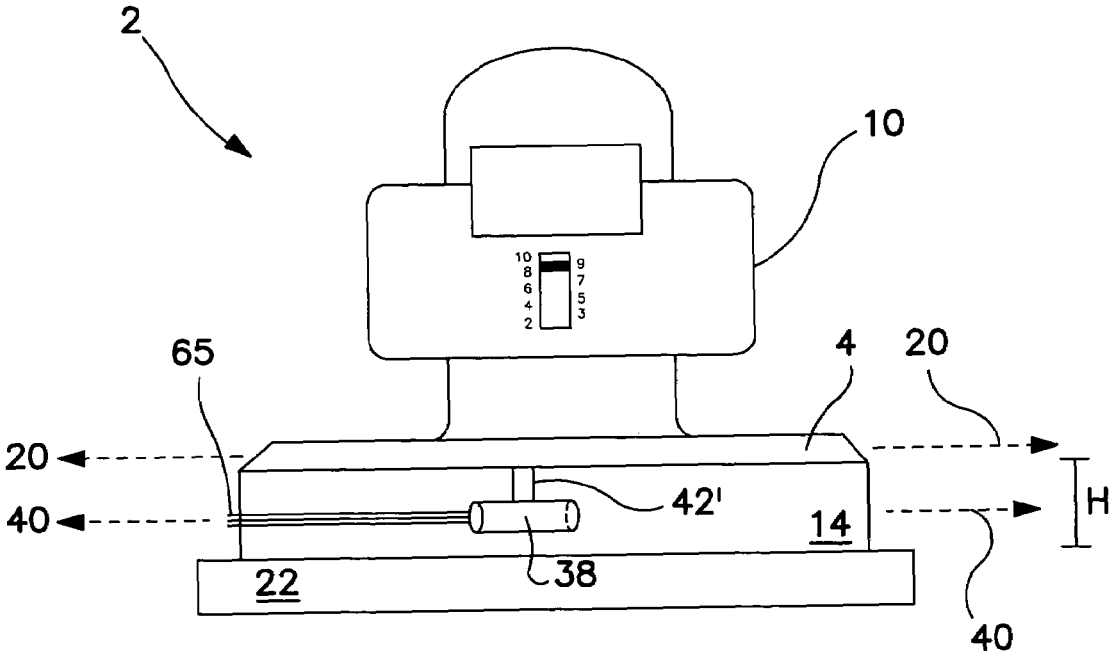

FIGS. 1A–1C present side and end views of one embodiment of the binding of the present invention, shown mounted on a ski. Each of the ski bindings 2 shown in FIGS. 1A–C includes a supporting boot plate 4 to which a boot (not shown) such as, for example, an alpine ski boot may be secured. Any suitable mechanism that secures the boot to the boot plate 4 and which prevents separation of the boot from the boot plate 4 may be used, such as the toe and heel jaws or receptors 8 and 10 shown, or any other conventional step-in engagement and step-out disengagement fasteners. The receptors 8 and 10 may include safety release features that will not be described in detail here, but are similarly known and allow quick removal of the boot away from the boot plate 4 with a particularly swift motion when some threshold vertical, lateral and/or angular limit or torsion stress (in excess of a preset release torque) is exceeded. Boot plate 4 is preferably attached at a forward end 12 to a ski plate 14 by a pivoting toe section 16 including intermediary linkage formed to allow pivoting of the boot plate 4 along an axis 18 (shown in FIG. 1A) transverse to the longitudinal axis 20 (shown in FIG. 1C) of the boot plate 4 by lifting and lowering the rearward end 28 of the boot plate 4. The ski plate 14 is in turn affixed to ski 22. The binding 2 preferably has a spring 24 or other means that causes the ski plate 14 and ski 22 to "clap up" (in the direction of arrow 26) from the disengaged position, shown in FIG. 1A, to the engaged position shown in FIG. 1B.

In the disengaged position shown in FIG. 1A, the rearward end 28 of the boot plate 4 is at a position that is not in close proximity to the ski plate 14. In this position, a locking means 30 is in an unlocked position. This disengaged position occurs during each skating motion at the beginning of a ski race when the skier is attempting to build up speed. FIG. 1B illustrates an engaged position of the boot plate 4 wherein the rearward end 28 of the boot plate 4 is near the ski plate 14 and ski 22 and the locking means 30 is engaged (i.e. components described below that comprise the locking means are either in contact with or in close proximity to each other) and possibly locked. During a portion of each skating motion at the beginning of the ski race, and for the remainder of the ski race after a predetermined number of skating motions, the rearward end 28 of the boot plate 4 is engaged with the ski plate 14 and ski 22.

Those of skill in the art will readily appreciate that the pivoting toe section 16 can be designed in a wide variety of ways that satisfy the purpose of allowing angular rotation at the forward end 12 of the boot plate 4. In the depicted embodiment, the pivoting toe section 16 is comprised of a hinge 32 secured to the forward end 12 of the boot plate 4 and a fastening plate 34 secured to the ski plate 14. The hinge 32 provides a mechanism for angular rotation of the boot plate 4 and assists in maintaining alignment of the individual components of the locking means 30. This hinge alignment function is especially useful in ski binding designs that allow the rearward ends of the boot plate and ski plate to rotate laterally away from the ski. The pivoting forward end 12 of the boot plate 4 and hinge 32 are generally cylindrical but may have a flat 36 that limits the extent of rotation of the boot plate 4 about the axis 20. Another pivoting toe section (not shown) utilizes a pair of rigid arms rotatably linking the boot plate and ski plate through corresponding lateral recesses in the boot plate and ski plate, and restricting lateral movement of the boot plate while in the disengaged position such that the rearward end of the boot plate will guide the return to the engaged position proximate the ski and ski plate.

Most ski racers use "plates" or "lifts" between their bindings and their skis. This extra lift makes it easier to carve an edge (i.e., one needs to shift less with the legs to make the edge dig in). The ski plate 14 allows the binding 2 to additionally function as a "lift". Referring again to FIGS. 1A–C, boot plate 14 preferably has a height H determined by the maximum lift level(s) specified by the United States Skiing Association and/or the World Cup, which allow 55 mm total height for bindings with plates.

Figure 2A:
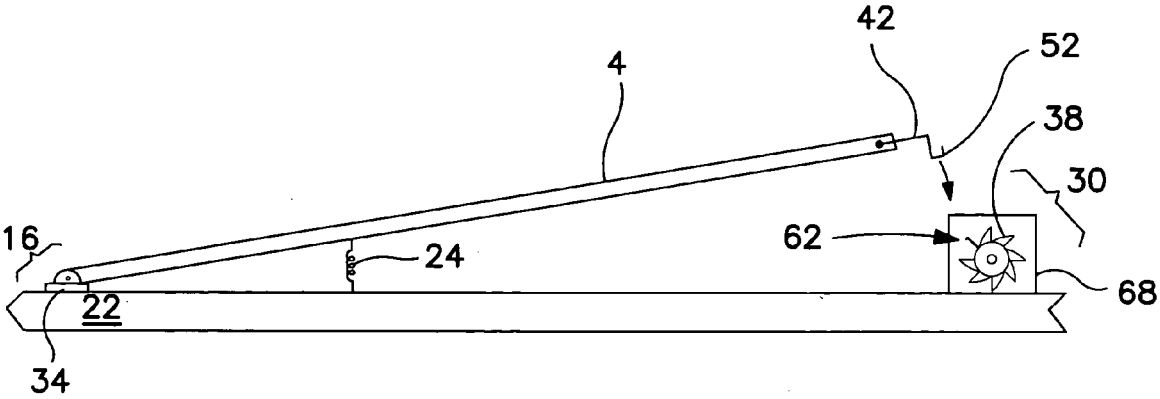
FIGS. 2A, 2B are side views of the binding of the present invention shown in the disengaged position.
Figure 2B:
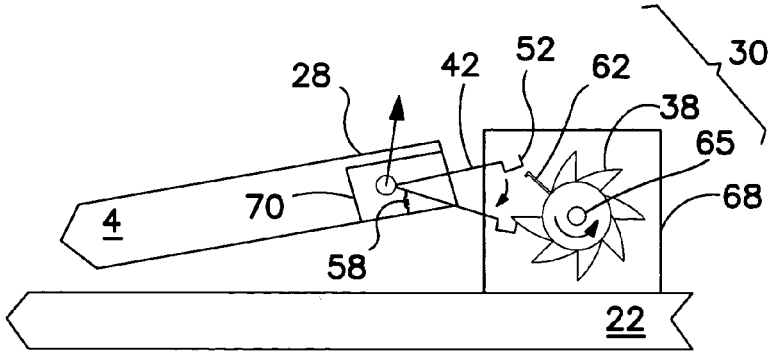

Though preferred, the present invention is not limited to bindings that use ski plates. With reference to FIGS. 2A–B, embodiments exist wherein the boot plate 4 engages and disengages directly to and from the ski 22. In such alternative embodiments, at least one of the components of locking means 30 is affixed directly to the ski 22, as is hinge plate 34 in the absence of a ski plate.

The locking means 30 allows the binding to automatically lock the boot plate 4 in the engaged position (i.e., in close proximity to and potentially in contact with the ski plate and/or ski) after a pre-selected number of skating motions (or "skates") so that the skier can race the majority of the competition in the engaged position. A number of mechanisms and configurations that can be employed to achieve this objective will now be described. As the term "selected" is used herein, it means the action of a skier prior to a race in choosing to use a particular binding setting that will allow a predetermined number of skates before locking, or in some embodiments, adjusting a control feature on a more robust version of the locking means that allows the locking means to lock after the desired number of skates or time interval.

With reference to FIGS. 1A–1C, preferred embodiments of the dynamic locking means 30 include a gear 38 rotatable about an axis 40 (shown in FIG. 1C) and a rigid element 42 that interacts with the gear 38 in such a way as to lock the boot plate 4 to the ski plate 14 after the desired number of skates.

Figure 4A:
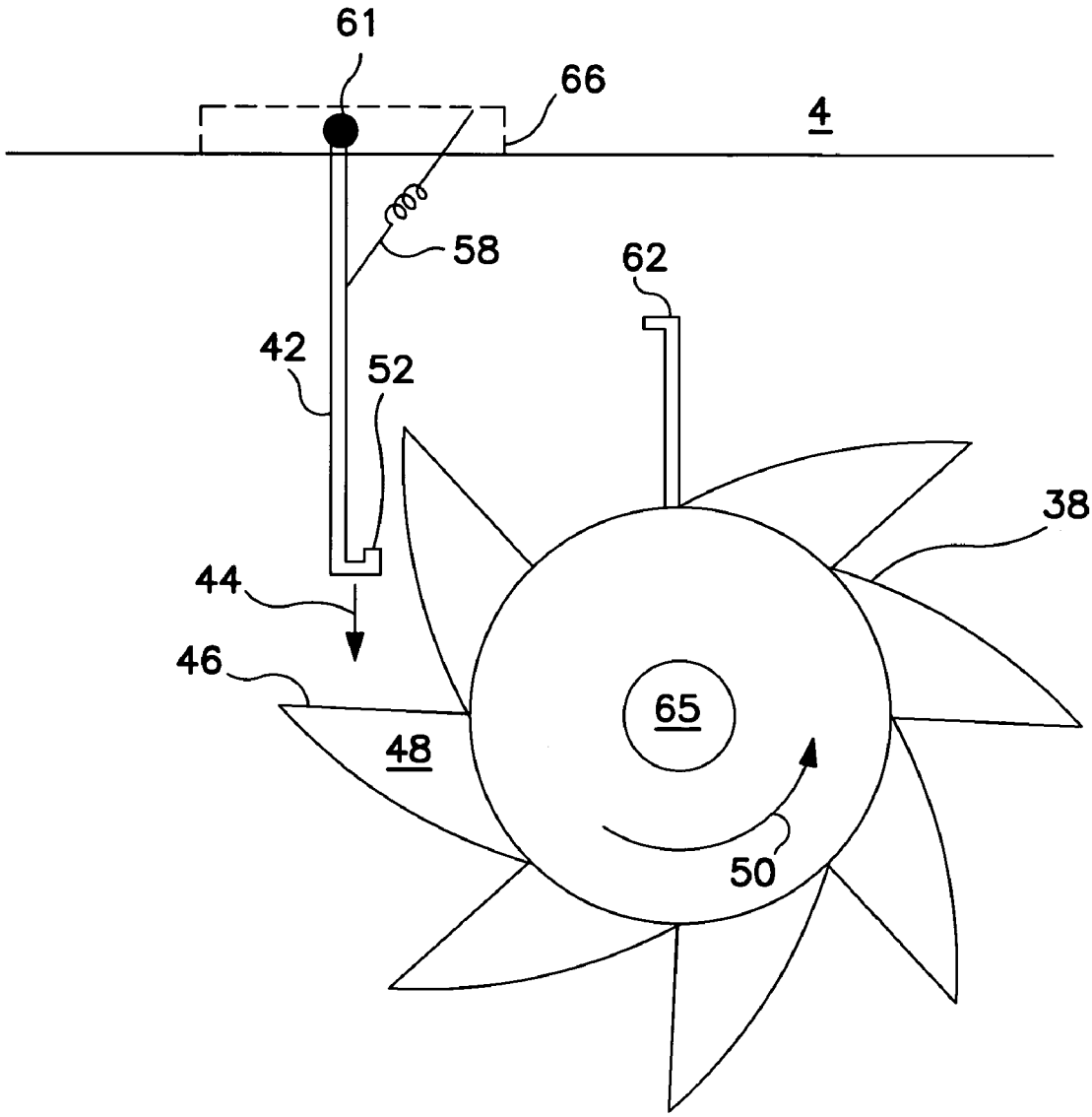
FIGS. 4A–4E are schematic illustrations of the operation of a gear mechanism employed in certain embodiments of the present invention.
Figure 4B:
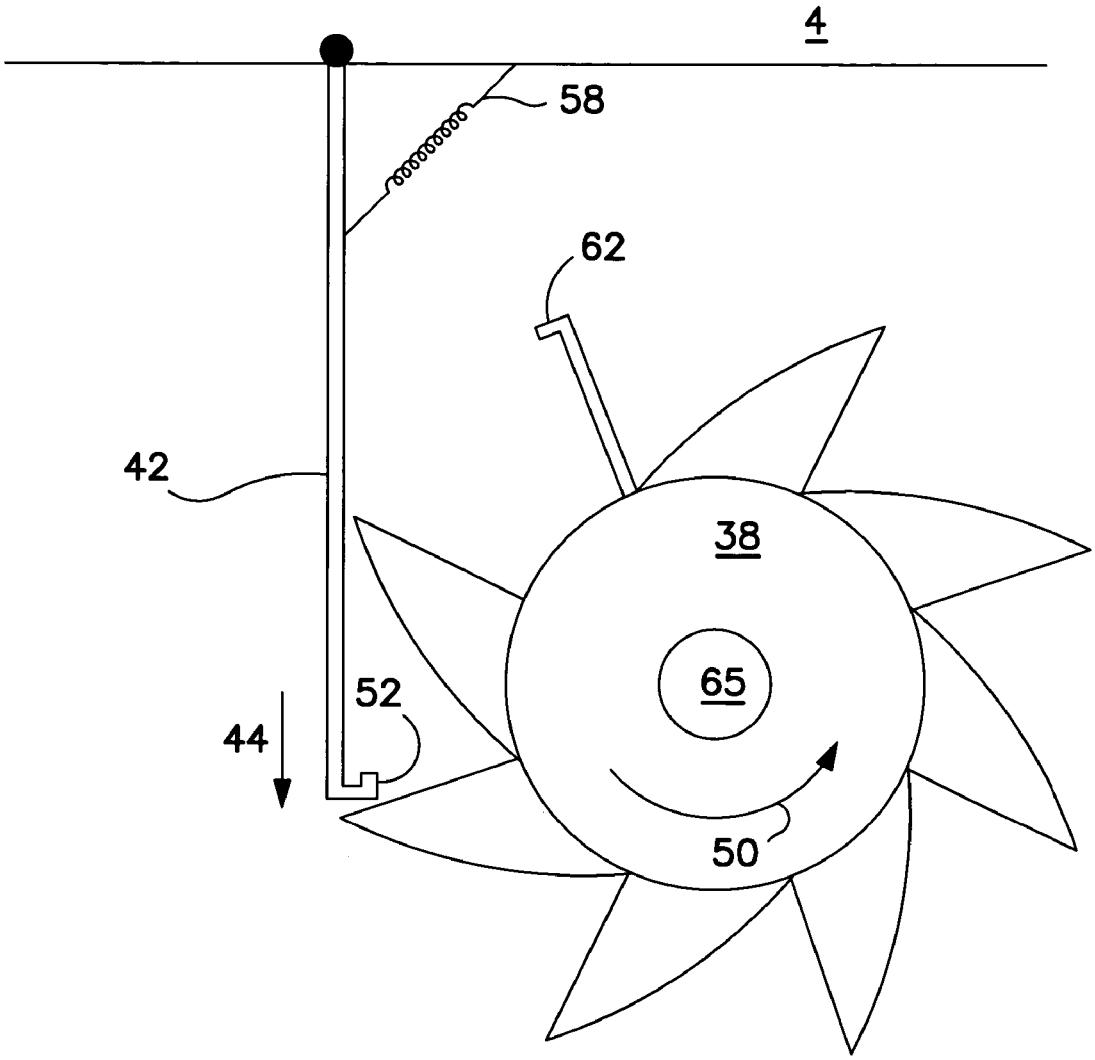

FIGS. 4A–4E provide a more detailed illustration of the operation of the gear 38, which is embedded within either the ski plate or the boot plate, and element 42, which protrudes from the plate opposed to the plate housing the gear 38. The gear 38 in each of FIGS. 4A–4E represent the same gear. FIGS. 4A–4B illustrates a step of the dynamic locking process wherein, as a result of the boot plate and ski plate engaging, element 42 exerts a force (in the direction of arrow 44) through contact with the face 46 of a tooth 48 of gear 38. The applied force results in an incremental rotation (in the direction of arrow 50) of the gear, rotationally advancing the gear 38 each time the boot plate 4 approaches sufficiently near the ski plate 14.

Figure 4C:
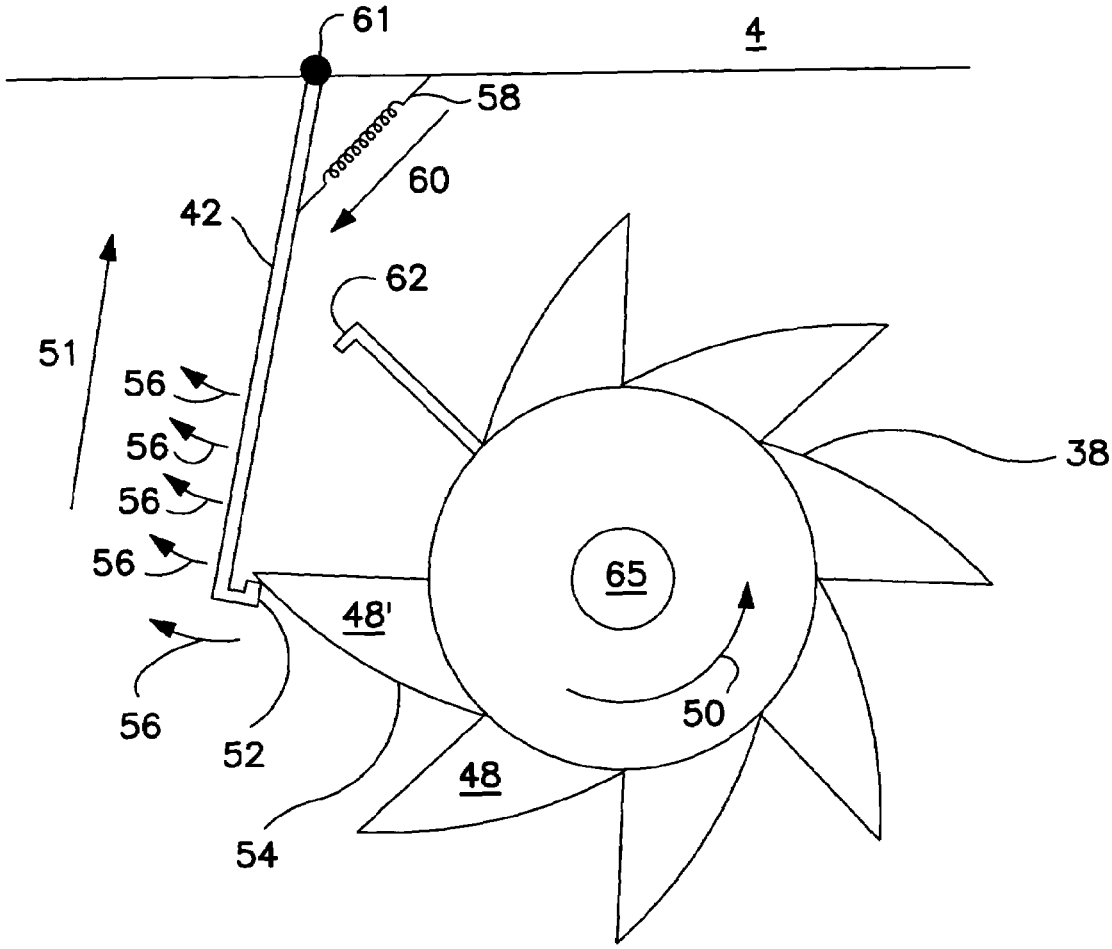

FIG. 4C illustrates the interaction of locking means components that occurs when the boot plate and ski plate disengage (because the desired number of skates has not been attained.) As the boot plate and ski plate attempt to disengage, element 42 is drawn away from the gear 38 (in the direction of arrow 51). A hooking means 52 located at the gear-contacting end of the element 42 now contacts and is drawn across the backside 54 of the next tooth 48' (in the direction of arrows 56.) As the gear 38 is designed to rotate in only the counter-clockwise direction, the element 42 is urged by resistive force provided by the curved backside 54 of tooth 48' away from a position normal to the boot plate 4. Although not shown, there exists of course a reset mechanism that frees the gear to reversibly rotate so that the locking mechanism may be used again in subsequent ski races. Such release mechanism are well known in the art. A spring 58 connected to the element 42 and boot plate 4 is stretched in the direction of arrow 60 to allow the element 42 to rotate about pivot 61, but which urges the element 42 back to an orientation normal to the boot plate after the hooking means 52 clears tooth 48'. Although the spring is depicted as being attached to a surface of the boot plate 4, in some embodiments a portion or all of the spring 58 is embedded within a recess 66 of boot plate 4 (as is a portion of element 42 and pivot 61, such as shown in FIG. 4A, thereby being protected from a potentially harsh environment.)

Figure 4D:
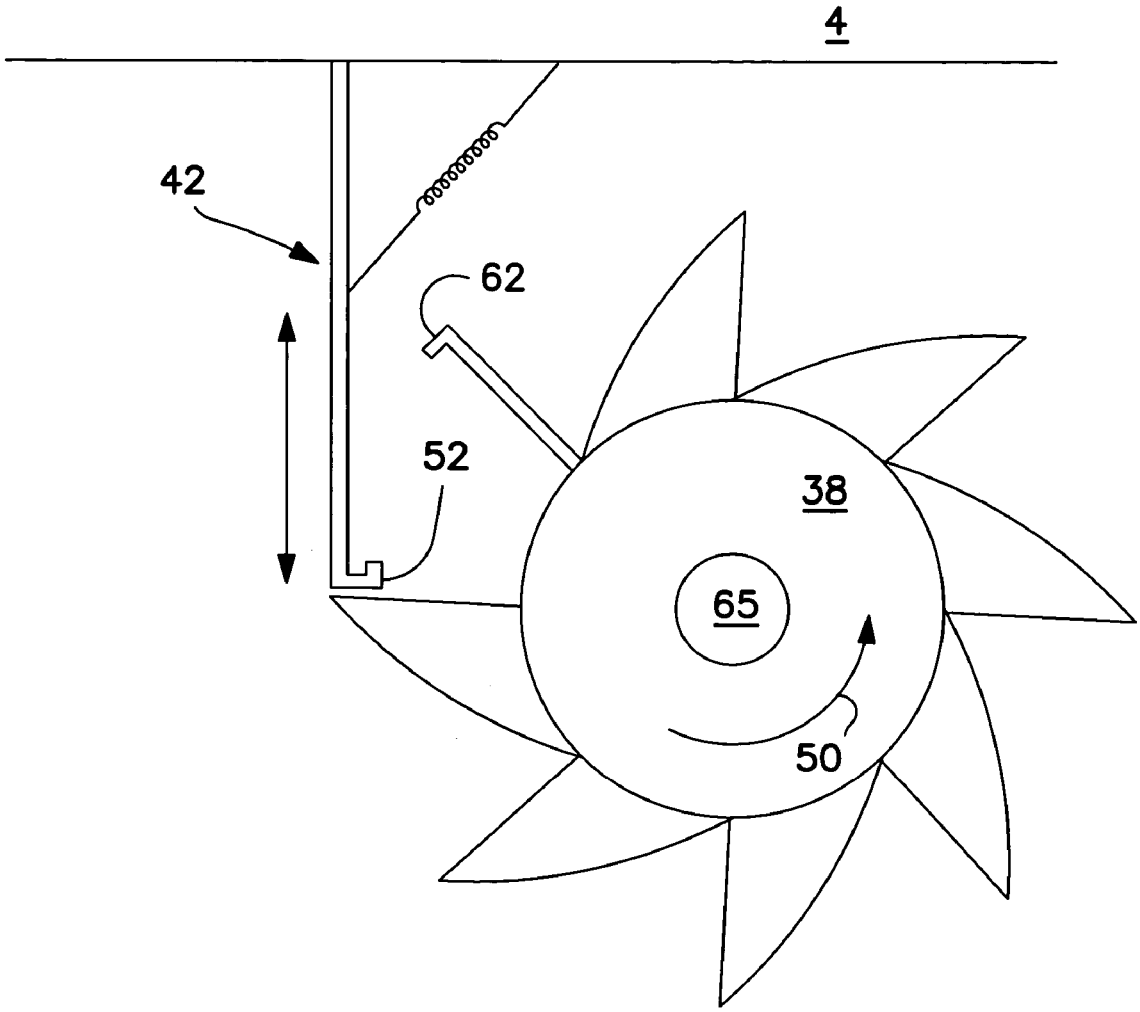
Figure 4E:
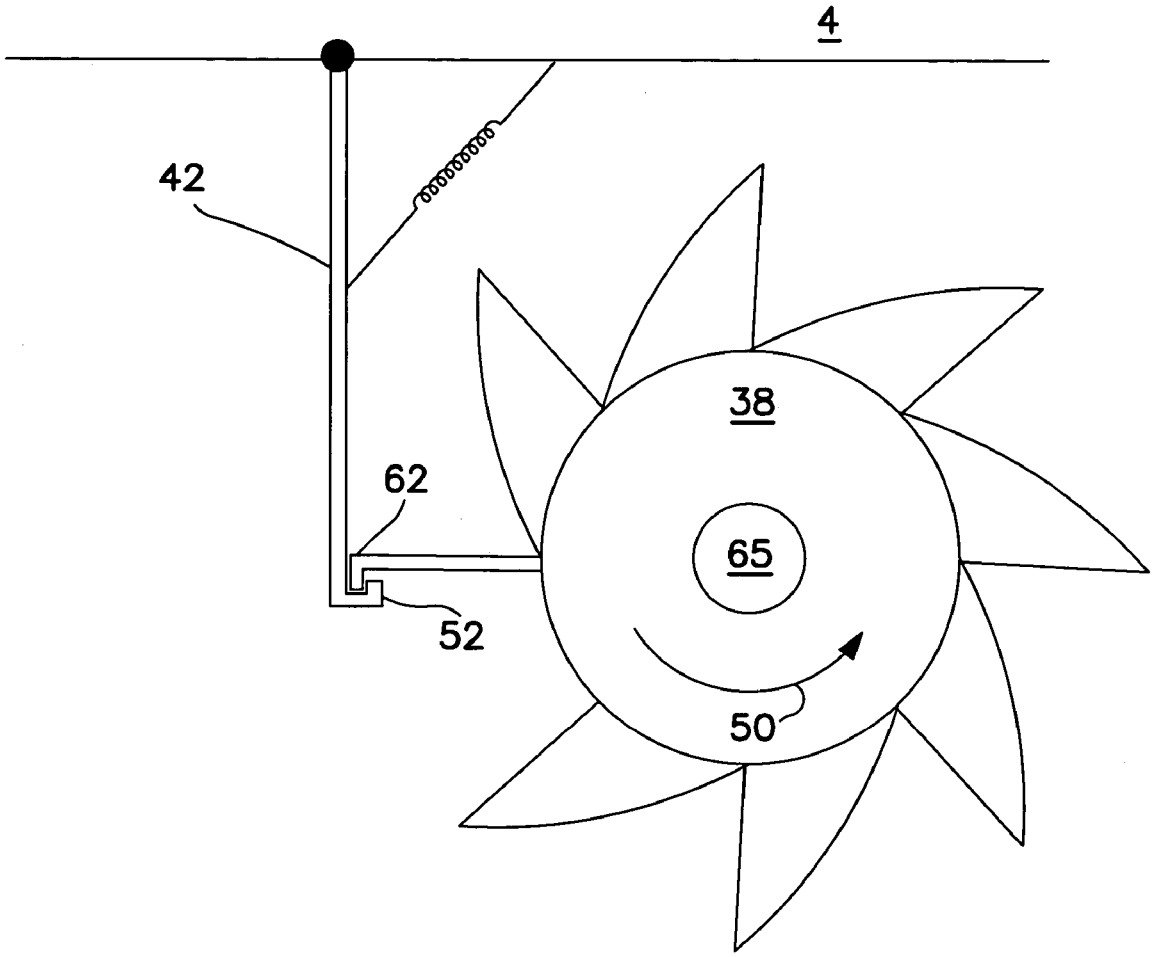

FIGS. 4D–4E illustrate the interaction of the hooking means 52 of element 42 and a mated hook 62 that occurs when the desired number of skates has been achieved. As above, engagement of the boot plate 4 and ski plate urges the element 42 to convey a rotational force to gear 38. This time, however, mated hook 62 is rotated into a locked position with respect to the hooking means 52 such that any attempt of boot plate 4 to disengage from the ski plate will be prevented. The number of skates that can occur before this locking takes place is determined by the number of teeth of gear 38 that are incrementally encountered by element 42 and can be preselected by proper rotational positioning of the gear at the start of a ski race. The preselection (i.e., the starting rotational position of the gear) can be adjusted by the skier using control knob 65 (FIGS. 1C, 4A, 4E)

Referring again to FIGS. 2A–2B, in embodiments of the invention wherein no ski plate is utilized, the gear 38 may be disposed in a separate housing 68 directly mounted on the ski 22 while the rigid element 42 protrudes horizontally from within a recess 70 in the rearward end 28 of the boot plate 4. The locking means 30 otherwise operates as described above. Note that spring 58 may be arranged in a configuration differently than in the configuration shown above, as in this design it applies a repulsive force (rather than an attractive force as in the prior embodiment) that allows the element 42 to pivot but returns the element 42 to a substantially normal position with respect to the end of the boot plate. As described above, the number of skates that are allowed before the boot plate 4 is locked in the engaged position is determined by the number of rotation increments that the gear 38 experiences before the hooking means 52 locks with the mated hook 62 to constraint boot plate movement. The number of rotation increments encountered is similarly selectable by rotating the gear 38 to a position such that the desired number of gear teeth are encountered by element 42 the boot plate and ski engage. Knob 65 coaxially integrated with gear 38 is adjustable to select the number of gear teeth that should be encountered. Other means for rotating the gear such that the proper number of gear teeth are encountered may alternatively be employed.

Figure 5:
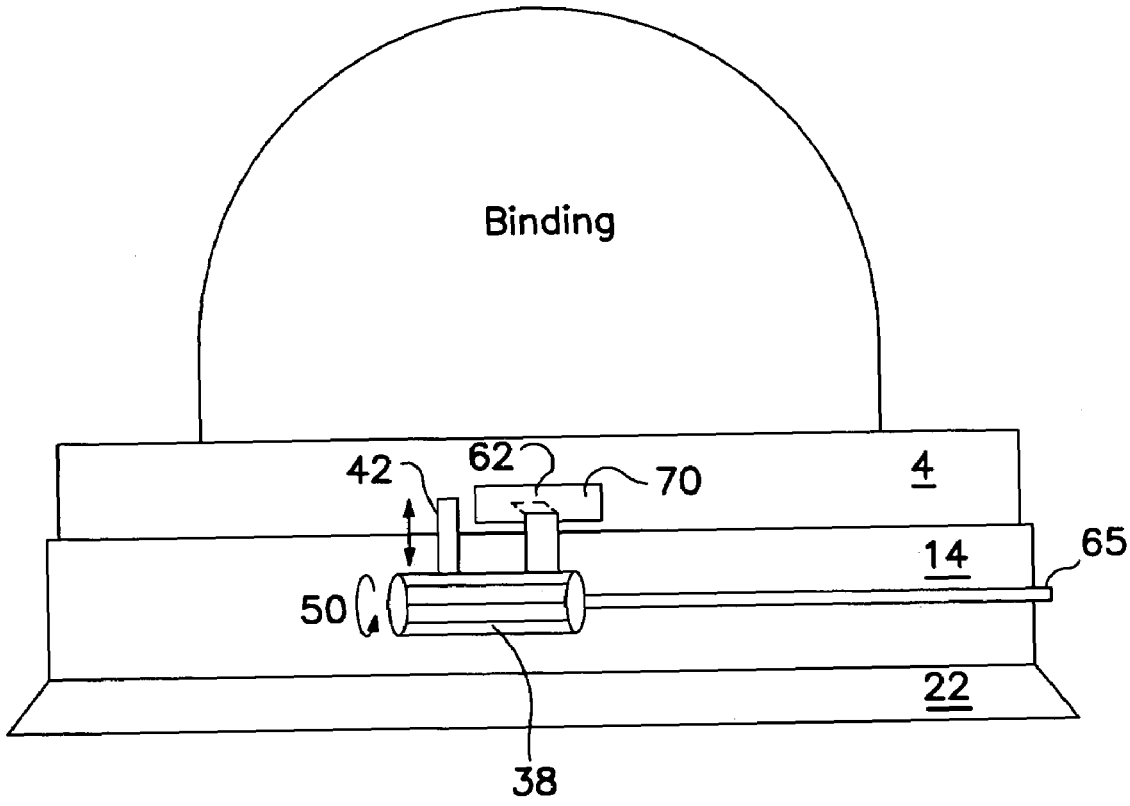
FIG. 5 is an end view of a locking mechanism in accordance with the present invention.

Those of skill in the art will appreciate that a wide variety of alternative gear and hooking configurations are possible. For example, FIG. 5 is a cross sectional end view of the locking means integrated within the boot plate 4 and ski plate 14. The figure illustrates that rather than having the rigid element 42 equipped with a hook at its end, the mated hook 62, still a feature of gear 38, is an element that does not interlock with the rigid element 42 but is still disposed at a position about the circumference of gear 38. Mated hook 62 instead latches into a notch or recess 70 on or within the boot plate 4 and dimensioned to securely receive the hook 62. Since the gear is designed to rotate in only one direction (without resetting/releasing the gear mechanism), once the hook 62 locks into the recess 70, the boot plate and ski plate will no longer disengage. In this embodiment, the element including hook 62 is dimensioned to extend radially a greater length from the center of gear 38 than normal gear teeth, in order that thee hook engage the recess but the gear teeth will not contact the boot plate 4 or engaging recess 70.

Figure 3:
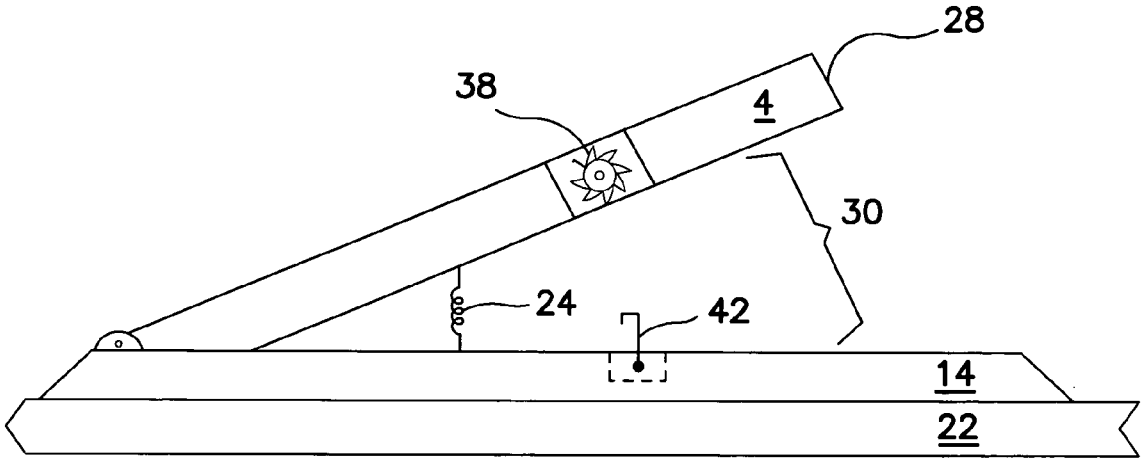
FIG. 3 is a side view of another embodiment of the binding of the present invention configured with a ski plate and illustrated in the disengaged position.

FIG. 3 illustrates several alternative design features of the locking mechanism 30. First, it is to be noted that the relative positions of the gear 38 and rigid element 42 have been reversed, wherein the gear 38 is now disposed in the boot plate 4 rather than on the ski plate 14 and the element 42 is now connected to the ski plate 14. Another feature to note is that the dynamic locking means 30 is not limited to positions at the far rearward end 28 of the boot plate 4. It may be preferable, in some circumstances, to arrange the elements of the locking means such that they do not interfere with other ski binding components, or to minimize clogging from loose snow.

Yet other embodiments of the locking means are possible. It should be understood that the foregoing description and drawings are provided for exemplary purposes only, and are by no means is the invention to be limited thereto. For example, the rotation of the gear 38, though shown in each of the figures as being about the rotational axis 40 (FIG. 1C) transverse to the longitudinal axis of the ski may instead be arranged such that the rotational axis 40 is parallel to the ski axis. If one employs bevel gearing, the rotational axis 40 may also be normal to the face of the ski 22.

Figure 6:
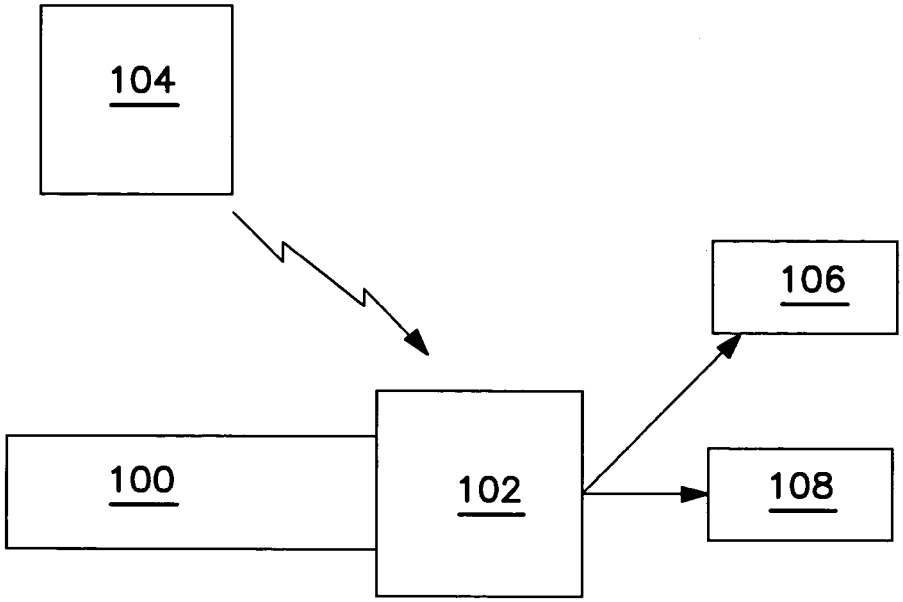
FIG. 6 is a block diagram of an electromagnetic locking mechanism in accordance with the present invention.

In another embodiment of the present invention, the locking means 30 is realized through the use of electromagnetic circuitry. FIG. 6 presents a simplified block diagram of a dynamic locking means 30 that allows selection of the number of skates (or time interval) upon which the boot plate will lock in the engaged position to the ski plate and/or ski. The electronic components of the locking means and/or their protective housing must be of durable construction to withstand the vibrational and impact forces and moisture and temperature effects of water/snow.

Figure 7:
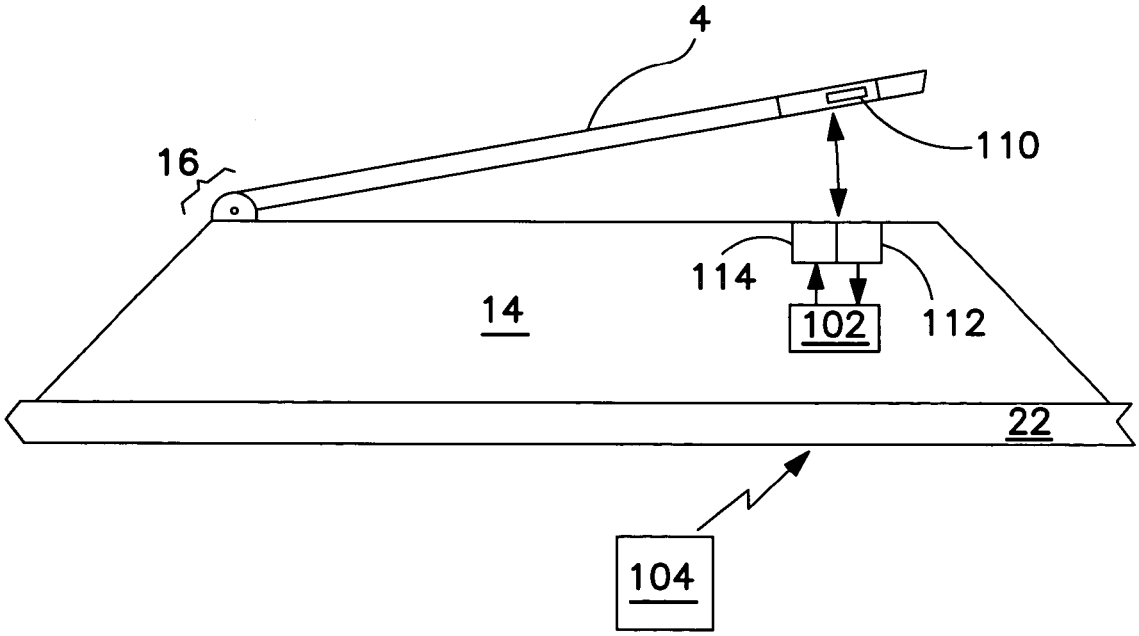
FIG. 7 is a schematic illustration of the electromagnetic embodiment of the dynamic locking mechanism as preferably positioned in portions of a boot plate and a ski plate mounted on a ski.

The basic elements of such a locking means include a sensor system 100, logic unit 102, user input module 104 (which as described below may be physically remote from the remainder of the locking means components on the ski binding), and either a mechanical actuator 106 or an electromagnet 108. A portable power supply is not shown, but such supplies (e.g., batteries) are well-known. A variety of sensing technologies exist that are adequate to detect the proximity (below some threshold separation distance) of the ski binding plates and generate a responsive electrical signal. Sensor system 100 comprises an interferometric optical, magnetic and/or piezoelectric based sensor. In a preferred embodiment shown in FIG. 7, the sensing system includes an element 110 embedded in one of the opposing plates (e.g., boot plate 4) and a sensor 112 in or on the other plate (e.g., plate 14) that can detect the proximity of the element 110 as the boot plate and ski plate (or ski) come into close proximity. In order for a piezoelectric sensor to be employed, an actual pressure must be applied to the piezoelectric crystal, requiring contact between the plate (or some feature thereupon) and the crystal during the skating motion of the skier.

When sensor 112 detects engagement between the binding plates, a signal is sent to logic unit 102, which is preferably a simple microprocessor having input/output, reset, and counting capabilities. (In simplified designs, logic unit 102 may be implemented purely in CMOS or TTL hardware with or without the ability to select at the beginning of each ski race how many skates are to trigger locking.) Logic unit 102 will count the number of skates that have been accomplished. (Alternatively, the skating interval may be defined in terms of a time interval beginning at the start of the race.) User input module 104 in communication with logic unit 102 is used to reset the locking means and counter at the start of a ski race, releasing the boot plate to move freely relative to the ski plate, and also to select the skate number trigger. Input module 104 may comprise one or more buttons or an input panel physically located on the ski binding, or alternatively may communicate through radio frequency signals to the logic unit 102 to eliminate accidental input during the competition.

When logic unit 102 has counted the pre-selected number of skates, it sends a control signal to an electromagnetic locking means 114 to secure the boot plate 4 to the ski plate 14. The electromagnetic locking means can consist of a variety of components and configurations. The power requirements of this circuit are not discussed in detail because it is known in the art how to power circuits such as these with portable batteries.

In one embodiment, the locking means 114 comprises an electromagnetic actuator 106 that is activated by the signal received from logic unit 102 that results in mechanical latching of the boot plate 4 to the ski plate 14 such as, for example, through utilization of one or more mateable hooks or a hook and notch/recess as described above. Electromagnetic actuators have been in existence for decades and will not be described in detail here, but in general include a magnetic field generating component and an actuator member susceptible to a magnetomotive force applied by the field so as to be displaced into a locked/latched position.

In another embodiment, the locking means 114 comprises an electromagnetic lock including two components, one each disposed in the opposing plates, that are capable of being detachably coupled by controlled magnetic interaction of one or more electromagnets. In response to the signals from logic unit 102, the electromagnet(s) are turned on or off as desired. The strength of the electromagnetic lock should be sufficient to withstand transverse sliding loads (e.g., in excess of 500 lbs.) such that the normal forces of skiing and carving turns cannot cause the locking system to fail. The logic unit 102 should also have a 'fail safe' condition wherein, in the event of a logic unit 102 malfunction, the electromagnet will immediately become activated. The magnetic field produced is preferably of sufficient strength to pull the two binding plates together upon the triggering skate number even if the binding plates are not completely in contact. If the plate opposed to the electromagnet is not comprised of a magnetizable material, a magnetizable insert integral to the plate opposed to the electromagnet will provide be necessary.

In yet another embodiment of the present invention, the locking means 30 comprises a reel and a strong water-resistant cable (wire) wound around the reel but attached on one end to the opposing binding plate such that the wire will unfurl when the binding plates are in the disengaged position. The locking means can alternatively operate using either the gear-based principles or the electronic sensing systems described above.

In the sensor system embodiment, each time the skier makes a skate, the reel unfurls wire in an unimpeded manner and then collects the wire again as the ski claps back up to the boot plate. After the triggering number of skates is detected, the reel is automatically constrained from unfurling wire, thereby locking the binding plates in the engaged position for the remainder of the race. A wide variety of mechanisms could be employed and are known in the art to constrain a reel from unfurling the wire, and thus will not be described herein.

In the gear-based embodiment, a gear similar to the gear described above, is incrementally rotated each time wire is unfurled from the reel. Upon attaining the preset number of skates (i.e., corresponding to the number of incremental gear rotations), a hooking or latching means as described above will have rotated into such a position as to lock the binding plates together for the remainder of the ski competition.

Although the invention has been described with respect to various embodiments, it should be realized this invention is also capable of a wide variety of further and other embodiments within the spirit of the invention, which is limited only by the appended claims.

It is claimed:

1. An improved downhill ski binding for connecting a boot to an elongated ski having a substantially planar upper surface on which the binding is mounted, comprising:

a boot plate securable to the boot having a forward end and a rearward end;

a pivotal toe section affixed to the forward cad of the boot plate constraining motion of the boat plate relative to the ski such that the rearward end of the boot plate can pivot in multiple directions relative to the ski; and a locking means for dynamically locking the rearward end of the boot plate proximate the ski after a pre-selected number of skating motions; a ski plate having a forward and a rearward end, the ski plate secured to the ski at least at the pivotal toe section and disposed between the ski and the boot plate; and wherein the locking means further comprises an operative engagement means allowing the rearward end of the boot plate to pivotably disengage from an engaged position adjacent the rearward end of the ski plate for the pre-selected number of skating steps and securing in the engaged position the rearward end of number of skating steps and securing in the engaged position the rearward end of the boot plate to the ski plate after the pre-selected number of skating motions.

2. The downhill ski binding of claim 1, further comprising means for selecting the number of skating steps to be allowed before locking the rearward end of the boot plate proximate the ski.

3. The downhill ski binding of claim 1, wherein the operative engagement means further comprises means for selecting a desired number of disengagements of the rearward end of the boot plate from the engaged position.

4. The downhill ski binding of claim 1, wherein a combined, substantially uniform thickness of the boot plate and the ski plate is less than a maximum thickness specified in national or international skiing equipment standards.

5. The downhill ski binding of claim 1, wherein the engagement means further comprises:

a gear having at least one tooth and a hook disposed about a circumference of the gear, the gear rotatably secured to one of the ski plate or the boot plate and rotatable in one direction only;

a mateable portion secured to the other of the ski plate or boot plate and dimensioned to receive the hook;

a rigid element pivotably secured to the other of the ski plate or boot plate for rotating the gear an increment of one tooth each time the rearward end of the boot plate is pivoted to the engaged position, until the hook is received by the mateable portion and further pivoting of the boot plate is prevented; and a spring having a first end and a second end, the spring secured on the first end to the other of the ski plate or boot plate and on the second end to a portion of the rigid element to return the rigid element after the boot plate and ski plate disengage to an orientation that will engage the gear upon the next engagement of the boot plate and ski plate.

6. The downhill ski binding of claim 5, wherein the rotational position of the gear may be adjusted such that a desired number of disengagements of the rearward end of the boot plate from the engaged position may be preselected.

7. The downhill ski binding of claim 5, wherein the gear is disposed relative to the ski such that the rotational axis of the gear has an orientation selected from among the group consisting of transverse to the axis of the ski relatively parallel to the upper surface of the ski, transverse to the axis of the ski substantially normal to the upper surface of the ski, and parallel to the axis of the ski.

8. The downhill ski binding of claim 1, wherein the locking means is located near the rearward end of the plate.

9. The downhill ski binding of claim 1, wherein the locking means further comprises an operative engagement means for allowing the rearward end of the boot plate to pivotably disengage from an engaged position adjacent the ski for the pre-selected number of skating motions and for securing the rearward end of the boot plate in the engaged position after the pre-selected number of skating motions.

10. The downhill ski binding of claim 9, wherein the operative engagement means further comprises means for selecting a desired number of disengagements of the rearward end of the boot plate from the engaged position.

11. The downhill ski binding of claim 9, wherein the engagement means further comprises:

a gear having at least one tooth and a hook disposed about a circumference of the gear, the gear rotatably secured within one of the boot plate or a housing affixed to the ski; and wherein the other of the boot plate or the housing affixed to the ski includes a mateable portion dimensioned to receive the hook and a rigid element for rotating the gear an increment of one tooth each time the rearward end of the boot plate is pivoted to the engaged position until the hook is received by the mateable portion and further pivoting of the boot plate is prevented.

12. The downhill ski binding of claim 11, wherein the rotational position of the gear may be adjusted such that a desired number of disengagements of the rearward end of the boot plate from the engaged position may be preselected.

13. The downhill ski binding of claim 11, wherein the gear is disposed relative to the ski such that the rotational axis of the gear has an orientation selected from among the group consisting of transverse to the axis of the ski relatively parallel to the upper surface of the ski, transverse to the axis of the ski substantially normal to the upper surface of the ski, and parallel to the axis of the ski.

14. The downhill ski binding of claim 1, wherein the locking means further comprises:

a user input module for inputting the desired number of skating motions;

a sensor for detecting an occurrence of the engaged position and outputting an indication that an occurrence of the engaged position has been detected;

a logic unit in communication with the user input module and sensor for receiving the input number of skating motions from the user input module and the indication of an occurrence from the sensor, counting the number of occurrences detected, and outputting a control signal upon attainment of the desired number of occurrences; and a lock in communication with the logic unit that is activated upon receipt of the control signal indicating attainment of the desired number of occurrences of the engaged position.

15. The downhill ski binding of claim 14, wherein the user input module comprises an input keypad and radio frequency transmitter for transmitting the input desired number of skating motions.

16. The downhill ski binding of claim 14, wherein the sensor is selected from the group consisting of optical interferometric, piezoelectric, or electromagnetic-based sensors.

17. The downhill ski binding of claim 14, wherein the lock comprises:

at least one hook disposed in or on one of the boot plate or ski plate;

at least one mateable portion disposed in or on the other of the boot plate or ski plate; and an actuator that drives the at least one hook into a locked position with respect to the at least one mateable portion.

18. The downhill ski binding of claim 14, wherein the lock comprises an electromagnet disposed in or on one of the boot plate or ski plate, the electromagnet providing a magnetic field strong enough to lock together the boot plate and ski plate.

19. The downhill ski binding of claim 18, wherein the magnetic field is strong enough to pull the boot plate and ski plate together if not already in the engaged position.

20. The downhill ski binding of claim 1, wherein the locking means further comprises:

a user input module for inputting the desired number of skating motions;

a sensor for detecting an occurrence of an engaged position wherein the rearward end of the boot plate is adjacent the ski and outputting an indication that an occurrence of the engaged position has been detected;

a logic unit in communication with the user input module and sensor for receiving the input number of skating motions from the user input module and the indication of an occurrence from the sensor, counting the number of occurrences detected, and outputting a control signal upon attainment of the desired number of occurrences; and a lock in communication with the logic unit that activates upon receipt of the control signal indicating attainment of the desired number of occurrences of the engaged position.

21. The downhill ski binding of claim 20, wherein the user input module comprises an input keypad and radio frequency transmitter for transmitting the input desired number of skating motions.

22. The downhill ski binding of claim 20, wherein the sensor is selected from the group consisting of optical interferometric, piezoelectric, or electromagnetic-based sensors.

23. The downhill ski binding of claim 20, wherein the lock comprises:

at least one hook disposed in or on one of the boot plate or a housing affixed to a rearward end of the ski;

at least one mateable portion disposed in or on the other of the boot plate or housing affixed to a rearward end of the ski; and an actuator that drives the at least one hook into a locked position with respect to the at least one mateable portion.

24. The downhill ski binding of claim 20, wherein the lock comprises an electromagnet disposed in or on one of the boot plate or ski plate, the electromagnet providing a magnetic field strong enough to lock together the boot plate and ski.

25. The downhill ski binding of claim 24, wherein the magnetic field is strong enough to pull the boot plate and ski together if not already in the engaged position.

26. The downhill ski binding of claim 1, wherein the operative engagement means comprises:

a rotatable reel in or on one of the boot plate or ski plate;

a wire wound around the reel and unfurlable by the rotation of the reel, one end of the wire attached to the other of the boot plate or ski plate; and means for preventing the rotation of the reel upon attainment of the desired number of skating motions.

27. The downhill ski binding of claim 1, wherein the locking means comprises:

a rotatable reel in or on one of the boot plate or housing affixed to a rearward end of the ski;

a wire wound around the reel and unfurlable by the rotation of the reel, one end of the wire attached to the other of the boot plate or housing affixed to the rearward end of the ski;

a gear having at least one tooth and a hook disposed about a circumference of the gear, the gear rotatably integrated with the reel such that each disengagement of the rearward end of the boot plate from the rearward end of the ski unfurls the wire, thereby rotating the reel and in turn rotating the gear an increment of one tooth; and wherein the other of the boot plate or the housing affixed to the rearward end of the ski includes a mateable portion dimensioned to receive the hook, such that the boot plate will be locked to the ski upon attainment of the pre-selected number of skating motions resulting in sufficient gear rotation for the mateable portion to receive the hook.

28. An improved downhill ski binding for connecting a boot to an elongated ski having a substantially planar upper surface on which the binding is mounted, comprising:

a boot plate securable to the boot and having a forward end and a rearward end;

a ski plate having a forward and a rearward end, the ski plate secured to the ski and disposed between the ski and the boot plate;

a pivotal toe section affixed to the forward end of the ski plate and the forward end of the boot plate such that the boot plate can pivot in multiple directions relative to the ski;

an operative engagement means allowing the rearward end of the boot plate to pivotably disengage from an engaged position adjacent the rearward end of the ski plate for the pre-selected number of skating steps and securing in the engaged position the rearward end of the boot plate to the ski plate after the pre-selected number of skating motions, the engagement means comprising:

a gear having at least one tooth and a hook disposed about a circumference of the gear, the gear rotatably secured to one of the ski plate or the boot plate and rotatable in one direction only;

a mateable portion secured to the other of the ski plate or boot plate and dimensioned to receive the hook;

a rigid element pivotably secured to the other of the ski plate or boot plate for rotating the gear an increment of one tooth each time the rearward end of the boot plate is pivoted to the engaged position, until the hook is received by the mateable portion and further pivoting of the boot plate is prevented; and a spring having a first end and a second end, the spring secured on the first end to the other of the ski plate or boot plate and on the second end to a portion of the rigid element to return the rigid element after the boat plate and ski plate disengage to an orientation that will engage the gear upon the next engagement of the boot plate and ski plate.

29. The downhill ski binding of claim 28, wherein the rotational position of the gear may be adjusted such that a desired number of disengagements of the rearward end of the boot plate from the engaged position may be pre-selected.

30. An improved downhill ski binding for connecting a boot to an elongated ski having a substantially planar upper surface on which the binding is mounted, comprising:

a boot plate securable to the boot having a forward end and a rearward end;

a pivotal toe section affixed to the ski and the forward end of the boot plate such that the boot plate can pivot in multiple directions relative to the ski; and an operative engagement means for allowing the rearward end of the boot plate to pivotably disengage from an engaged position adjacent the ski for the pre-selected number of skating motions and for securing the rearward end of the boot plate in the engaged position after the pre-selected number of skating motions; a ski plate having a forward and a rearward end, the ski plate secured to the ski at least at the pivotal toe section and disposed between the ski and the boot plate; and wherein the locking means further comprises an operative engagement means allowing the rearward end of the boot plate to pivotably disengage from an engaged position adjacent the rearward end of the ski plate for the pre-selected number of skating steps and securing in the engaged position the rearward end of number of skating steps and securing in the engaged position the rearward end of the boot plate to the ski plate after the pre-selected number of skating motions.

31. The downhill ski binding of claim 30, wherein the operative engagement means further comprises means for selecting a desired number of disengagements of the rearward end of the boot plate from the engaged position.

32. The downhill ski binding of claim 30, wherein the engagement means further comprises:

a gear having at least one tooth and a hook disposed about a circumference of the gear, the gear rotatably secured within one of the boot plate or a housing affixed to the ski; and wherein the other of the boot plate or the housing affixed to the ski includes a mateable portion dimensioned to receive the hook and a rigid element for rotating the gear an increment of one tooth each time the rearward end of the boot plate is pivoted to the engaged position until the hook is received by the mateable portion and further pivoting of the boot plate is prevented.

33. The downhill ski binding of claim 32, wherein the rotational position of the gear may be adjusted such that a desired number of disengagements of the rearward end of the boot plate from the engaged position may be preselected.

34. An improved downhill ski binding for connecting a boat to an elongated ski having a substantially planar upper surface on which the binding is mounted, comprising:

a boot plate securable to the boat and having a forward end and a rearward end;

a ski plate having a forward and a rearward end, the ski plate secured to the ski and disposed between the ski and the boot plate;

a pivotal toe section affixed to the forward end of the ski plate and the forward end of the boot plate such that the boat plate can pivot in multiple directions relative to the ski;

a logic unit for determining whether a pre-selected skating interval has been attained, and outputting a control signal upon attainment of the pre-selected skating interval; and a lock in communication with the logic unit that is activated upon receipt of the control signal to lock the rearward end of the boot plate proximate the rearward end of the ski plate.

35. The downhill ski binding of claim 34, further comprising:

a sensor for detecting an occurrence of an engaged position between the ski plate and the boot plate, and outputting to the logic unit an indication that an occurrence of the engaged position has been detected; and wherein the logic unit receives the indication of an occurrence from the sensor and counts the number of occurrences detected to determine whether the skating interval has been attained, the skating interval defined in terms of a number of occurrences of the engaged position, the occurrences corresponding to a number of skating motions.

36. The downhill ski binding of claim 35, wherein the sensor is selected from the group consisting of optical interferometric, piezoelectric, or electromagnetic-based sensors.

37. The downhill ski binding of claim 34, further comprising:

a user input module in communication with the logic unit for inputting the pre-selected skating interval; and wherein the logic unit receives the pre-selected skating interval.

38. The downhill ski binding of claim 37, wherein the user input module comprises an input keypad and radio frequency transmitter for transmitting the pre-selected skating interval.

39. The downhill ski binding of claim 34, wherein the lock comprises:

at least one hook disposed in or on one of the boot plate or ski plate;

at least one mateable portion disposed in or on the other of the boot plate or ski plate; and an electromagnetic actuator that drives the at least one hook into a locked position with respect to the at least one mateable portion.

40. The downhill ski binding of claim 34, wherein the lock comprises an electromagnet disposed in or on one of the boot plate or ski plate, the electromagnet providing a magnetic field strong enough to lock together the boot plate and ski plate.

41. An improved downhill ski binding for connecting a boot to an elongated ski having a substantially planar upper surface on which the binding is mounted, comprising:

a boot plate securable to the boot and having a forward end and a rearward end;

a pivotal toe section affixed to the ski and to the forward end of the boot plate such that the boot plate can pivot in multiple directions relative to the ski;

a logic unit for determining whether a pre-selected skating interval has been attained, and outputting a control signal upon attainment of the pre-selected skating interval; and a lock in communication with the logic unit that is activated upon receipt of the control signal to lock the rearward end of the boot plate proximate the ski.

42. The downhill ski binding of claim 41, further comprising:

a sensor for detecting an occurrence of an engaged position between the ski and the boot plate, and outputting to the logic unit an indication that an occurrence of the engaged position has been detected; and wherein the logic unit receives the indication of an occurrence from the sensor and counts the number of occurrences detected to determine whether the skating interval has been attained, the skating interval defined in terms of a number of occurrences of the engaged position, the occurrences corresponding to a number of skating motions.

43. The downhill ski binding of claim 42, wherein the sensor is selected from the group consisting of optical interferometric, piezoelectric, or electromagnetic-based sensors.

44. The downhill ski binding of claim 41, further comprising:

a user input module in communication with the logic unit for inputting the pre-selected skating interval; and wherein the logic unit receives the pre-selected skating interval.

45. The downhill ski binding of claim 44, wherein the user input module comprises an input keypad and radio frequency transmitter for transmitting the pre-selected skating interval.

46. The downhill ski binding of claim 41, wherein the lock comprises:

at least one hook disposed in or on one of the boot plate or the ski;

at least one mateable portion disposed in or on the other of the boot plate or the ski; and an electromagnetic actuator that drives the at least one hook into a locked position with respect to the at least mateable portion.

47. The downhill ski binding of claim 41, wherein the lock comprises an electromagnet disposed in or on one of the boot plate or the ski, the electromagnet providing a magnetic field strong enough to lock together the boot plate and the ski.

48. A ski and ski binding combination, comprising:

an elongated ski having a substantially planar upper surface;

a boot plate securable to the boot having a forward end and a rearward end;

a pivotal toe section affixed to the forward end of the boot plate constraining motion of the boot plate relative to the ski such that the rearward end of the boot plate can pivot in multiple directions relative to the ski; and a locking means for dynamically locking the rearward end of the boot plate in the engaged position after the pre-selected number of skating motions; a ski plate having a forward and a rearward end, the ski plate secured to the ski at least at the pivotal toe section and disposed between the ski and the boot plate; and wherein the locking means further comprises an operative engagement means allowing the rearward end of the boot plate to pivotably disengage from an engaged position adjacent the rearward end of the ski plate for the pre-selected number of skating steps and securing in the engaged position the rearward end of number of skating steps and securing in the engaged position the rearward end of the boot plate to the ski plate after the pre-selected number of skating motions.

49. The combination of claim 48, further comprising:

a ski plate having a forward and a rearward end, the ski plate secured to the ski at least at the pivotal toe section and disposed between the upper surface of the ski and the boot plate; and wherein the locking means further comprises an operative engagement means allowing the rearward end of the boot plate to pivotably disengage from an engaged position adjacent the rearward end of the ski plate and for securing in the engaged position the rearward end of the boot plate to the ski plate after the pre-selected number of skating, motions.

50. A ski and ski binding combination, comprising:

an elongated ski having a substantially planar upper surface;

a boat plate securable to a ski boot and having a forward end and a rearward end;

a pivotal toe section affixed to the forward end of the boot plate constraining motion of the boot plate relative to the ski such that the rearward end of the boot plate can pivot in multiple directions relative to the ski;

a logic unit for determining whether a pre-selected skating interval has been attained, and outputting a control signal upon attainment of the pre-selected skating interval; and a lock in communication with the logic unit that is activated upon receipt of the control signal to lock the rearward end of the boot plate proximate the rearward end of the ski plate.

51. The combination of claim 50, further comprising:

a ski plate having a forward and a rearward end, the ski plate secured to the ski at least at the pivotal toe section and disposed between the upper surface of the ski and the boot plate;

wherein the locking means further comprises a sensor for detecting an occurrence of an engaged position between the ski plate and the boot plate, and outputting to the logic unit an indication that an occurrence of the engaged position has been detected; and wherein the logic unit receives the indication of an occurrence from the sensor and counts the number of occurrences detected to determine whether the skating interval has been attained, the skating interval defined in terms of a number of occurrences of the engaged position, the occurrences corresponding to a number of skating motions.

52. The combination of claim 51, wherein the sensor is selected from the group consisting of optical interferometric, piezoelectric, or electromagnetic-based sensors.

53. The combination of claim 50, further comprising:

a user input module in communication with the logic unit for inputting the pre-selected skating interval; and wherein the logic unit receives the pre-selected skating interval.

54. The combination of claim 53, wherein the user input module comprises an input keypad and radio frequency transmitter for transmitting the pre-selected skating interval.

55. The combination of claim 50, wherein the lock comprises:

at least one hook disposed in or on one of the boot plate or ski plate;

at least one mateable portion disposed in or on the other of the boot plate or ski plate; and an electromagnetic actuator that drives the at least one hook into a locked position with respect to the at least one mateable portion.

56. The combination of claim 50, wherein the lock comprises an electromagnet disposed in or on one of the boot plate or ski plate, the electromagnet providing a magnetic field enough to lock together the boot plate and ski plate.

* * * * *